United States Patent [19]

Dessau

[11] Patent Number: 4,867,864

[45] Date of Patent: Sep. 19, 1989

[54] DEHYDROGENATION, DEHYDROCYCLIZATION AND REFORMING CATALYST

[76] Inventor: Ralph M. Dessau, 14 Celler Rd., Edison, N.J. 08817

[21] Appl. No.: 283,779

[22] Filed: Dec. 13, 1988

[51] Int. Cl.[4] ..... C10G 35/06

[52] U.S. Cl. ..... 208/138; 585/419; 585/421

[58] Field of Search ..... 585/419, 421; 208/138

[56] References Cited

U.S. PATENT DOCUMENTS 4,808,295 2/1989 Nemet-Mavrodin ..... 208/138

OTHER PUBLICATIONS

Bernard, *Proceed. 5th Conf. on Zeolites* (1980), published by Heyden, London (1980).

*Primary Examiner*—Curtis R. Davis

*Attorney, Agent, or Firm*—Alexander J. McKillop; Charles J. Speciale; Marina V. Schneller

[57] ABSTRACT

The invention relates to catalytic treatment of paraffin feeds to alter the hydrogen content of the feed, for example, by producing effluents the aromatic content of which exceeds that of the feed in which the catalyst is a non-acidic composition containing a strong dehydrogenation/hydrogenation metal and zeolite beta in non-acidic form.

38 Claims, No Drawings

DEHYDROGENATION, DEHYDROCYCLIZATION AND REFORMING CATALYST

FIELD OF THE INVENTION

Catalysis of dehydrogenation, dehydrocyclization and reforming processes is effected in the presence of a non-acidic composition containing a strong dehydrogenation/hydrogenation metal and zeolite beta. These processes exhibit low selectivity for light gas production.

BACKGROUND OF THE INVENTION

Dehydrogenation of aliphatic compounds produces known compounds the corresponding unsaturated analog. Those products can be employed in various processes. The most likely use of those products is in conversion processes to produce a variety of petrochemicals or liquid fuels like poly gasoline, motor alkylate and methyl tertiary butyl ether. Dehydrogenation requirements of each of the members of the group $C_2$–$C_5$ alkanes differ. Those differing requirements reflect the reaction pathways involved and the thermodynamic properties of the starting materials and of the products. For example, butane dehydrogenation conditions can also effect butane isomerization and cracking, as major side reactions, which decrease the selectivity of the specific reaction for the product. When catalyzed by a solid catalyst, those cracking side-reactions can result in coking and/or aging of the catalyst necessitating regeneration procedures.

Dehydrocyclization of aliphatic $C_6+$ compounds produces known aromatic compounds. For example, benzene and toluene are the products of n-hexane and n-heptane dehydrocyclization reactions.

Catalytic reforming is a process in which hydrocarbon molecules are rearranged, or reformed in the presence of a catalyst. The molecular rearrangement results in an increase in the octane rating of the feedstock. Thus, during reforming low octane hydrocarbons in the gasoline boiling range are converted into high octane components by dehydrogenation of naphthenes and isomerization, dehydrocyclization and hydrocracking of paraffins.

By way of illustration the significance of those reactions in reforming can be gleaned from a review of the following table from "Catalysis," Vol VI, P.H. Emmett (ed). Copyright 1958 by Litton Educational Publishing Company:

Octane Numbers of Pure Hydrocarbons

| Hydrocarbon | Blending research octane number (clear) |
|---|---|
| Paraffins: | |
| n-Butane | 113 |
| n-Pentane | 62 |
| n-Hexane | 19 |
| n-Heptane | 0 |
| n-Octane | −19 |
| 2-Methylhexane | 41 |
| 2,2-Dimethylpentane | 89 |
| 2,2,3-Trimethylbutane | 113 |
| Naphthenes (cycloparaffins): | |
| Methylcyclopentane | 107 |
| 1.1-Dimethylcyclopentane | 96 |
| Cyclohexane | 110 |
| Methylcyclohexane | 104 |
| Ethylcyclohexane | 43 |
| Aromatics: | |

-continued

Octane Numbers of Pure Hydrocarbons

| Hydrocarbon | Blending research octane number (clear) |
|---|---|
| Benzene | 99 |
| Toluene | 124 |
| 1,3-Dimethylbenzene | 145 |
| Isopropylbenzene | 132 |
| 1,3,5-Trimethylbenzene | 171 |

Naphtha reforming may also be utilized for the production of benzene, toluene, ethylbenzene and xylene aromatics. A valuable by-product of naphtha reforming is hydrogen, which may be utilized for hydrotreating and upgrading of other hydrocarbon fractions. Generally, the molecular rearrangement of molecular components of a feed, which occurs during reforming, results in only slight, if any, changes in the boiling point of the reformate (the product of reforming), compared to that of the feed. Accordingly, reforming differs from both cracking and alkylation, both refinery processes, each of which does result in changes of boiling range of the product compared to the feed. That is, in cracking, large molecules are cracked into smaller ones; whereas, in alkylation small molecules are rebuilt into larger molecules.

The most important uses of the reforming process are briefly mentioned: the primary use of catalytic reforming may be concisely stated to be an octane upgrader and a route to premium gasoline.

Catalytic reforming is the only refining process that is capable of economically making a gasoline component having high clear research octane ratings. The charge to the reformer (straight-run, thermal, or hydrocracker naphtha) is usually available in large quantities and is of such low quality that most of it would be unsaleable without reforming.

A correlative use of catalytic reforming is in its ability to produce gasolines of acceptable volatility over a wide range of yields, through proper selection of feedstock and/or operating conditions. The refiner is thus able to vary the yield of gasoline very substantially to meet demand fluctuations. For European demand patterns, where gasoline sales are limiting and it is desired to produce as much middle distillate as practicable, the reformer can be operated on a lighter, lower volume of naphtha to minimize gasoline production while maintaining high crude runs.

Hydrogen, although often considered a by-product, is still a valuable output from the reformer. Normally, it is produced in amounts ranging from 300 to 1200 SCF/Bbl, depending on the type of feed stock and reformer operating conditions. Reformer hydrogen is used to remove unwanted contaminants from reformer feed stocks, for hydrodesulfurization of distillates, hydrocracking of heavy fractions, hydrotreating of lubes and various chemical operations. Hydrogen availability and utilization is expected to assume increasing importance as pollution restrictions lead to increasing hydroprocessing in future years.

The importance of reforming is reflected by data which indicates that finished pool gasoline is about 35% reformate in complex refineries, but can run as high as 80% in topping-reforming refineries. As lead is phased out of gasoline, more and more straight run stocks which are now blended directly into gasoline will be reformed. All current commercial reformers use a platinum containing catalyst with a hydrogen recycle stream. Within this broad definition, there are a great number of different process designs. More than 75% of the industry's reforming capacity is classified as semi-regenerative. A semi-regenerative reformer is one which runs until the catalyst is coked and then is shut down and regenerated. The time period between regenerations varies from several months to as long as 1½ years.

Within the category of semi-regenerative reforming, a further breakdown can be made on the basis of operating pressure. Units with separator pressures of 450 psig or higher are considered high pressure units. Those with pressures of 300 psig or less are called low pressure units. Anything in between is intermediate pressure. Most of the older units are high pressure, while the newer designs are low or intermediate pressure. Lower pressures give better reformate yields at a given octane level.

Another type of reformer is the cyclic variety. A cyclic unit has the reactors manifolded in such a way that any reactor can be taken out of reforming service and regenerated while the other reactors are still reforming. The time period between regenerations for a cyclic reactor varies from 2 to 10 days. All cyclics are low pressure.

A third type of reformer that has recently been commercialized is the continuous unit. In this type of reformer, catalyst is withdrawn from the unit during reforming, regenerated in small batches in separate regeneration facilities and then replaced in the unit. The regeneration period for continuous units is about one month. As in the case for cyclic units, all continuous units are low pressure.

Prior to about 1950 chromium oxide or molybdenum oxide supported on alumina were used to effect the two functions of a reforming catalyst. The hydrogenation-dehydrogenation function for paraffin olefin conversion during reforming is effected by the metals chromium and molybdenum and more recently platinum, rhenium, admixtures thereof and noble-metal containing trimetallic alloys. Isomerization activity was provided by the acidified alumina.

From the commercialization of platinum reforming in the middle 1950's to the late 1960's, there were no significant improvements in reforming catalysts.

In the late 1960's a dramatic breakthrough in reforming catalysts occurred. This was the introduction of the platinum-rhenium bimetallic catalysts. These catalysts have greatly improved stability compared to platinum-only catalysts. By way of background, the platinum and platinum bimetallic catalysts were generally supported on carriers.

The standard dual functional reforming catalysts exhibited high selectivity for cracking. Recently, the patent literature has started to recognize the use of platinum and non-acidic zeolite containing catalyst compositions in reforming. It has been reported that nonacidic catalysts are superior to the dual functional catalyst in selectivities, for example, those nonacidic catalysts based on zeolite X, Y, L, omega and mordenite. J. R. Bernard, PROCEEDINGS OF THE FIFTH INTERNATIONAL ZEOLITE CONFERENCE, Zeolite Conference, p686–695 (Naples 1980).

Zeolites include naturally occurring and synthetic zeolites. They exhibit catalytic properties for various types of hydrocarbon conversions. Zeolites are porous crystalline aluminosilicates having definite crystalline structure as determined by X-ray diffraction studies. Such zeolites have pores of uniform size which are uniquely determined by unit structure of the crystal. The zeolites are referred to as "molecular sieves" because interconnecting channel systems created by pores of uniform pore size allow a zeolite to selectively absorb molecules of certain dimensions and shapes.

By way of background, one authority has described the zeolites structurally, as "framework" aluminosilicates which are based on an infinitely extending three-dimensional network of $AlO_4$ and $SiO_4$ tetrahedra linked to each other by sharing all of the oxygen atoms. Furthermore, the same authority indicates that zeolites may be represented by the empirical formula $$M_{2/n}O.Al_2O_3.xSiO_2.yH_2O$$

In the empirical formula, x is equal to or greater than 2, since $AlO_4$ tetrahedra are joined only to $SiO_4$ tetrahedra, and n is the valence of the cation designated m. D. Breck, ZEOLITE MOLECULAR SIEVES, John Wiley & Sons, New York p.5 (1974). In the empirical formula, the ratio of the total of silicon and aluminum atoms to oxygen atoms is 1:2. M was described therein to be sodium, potassium, magnesium, calcium, strontium and/or barium, which complete the electrovalence makeup of the empirical formula.

The pore sizes of medium pore zeolites range from about 5 to about 7 Angstroms.

Another class of zeolites sometimes referred to as large pore zeolites include inter alia naturally occurring faujasite, synthetic zeolites X,L,Y and zeolite beta. These zeolites are characterized by pore sizes greater than thoseoof the medium pore zeolites.

SUMMARY OF THE INVENTION

The invention relates to dehydrogenation of $C_2$–$C_5$ paraffins and to dehydrocyclization of $C_6$–$C_{12}$ paraffin components. Such components are present in naphthas subjected to reforming conditions. The $C_6$ and $C_7$ components are converted, under dual functional catalyst reforming conditions, only with difficulty. Accordingly, one advantage which can inhere in the invention is the increase in liquid yields.

The dehydrocyclization is catalyzed by a non-acidic catalyst composition comprising a strong hydrogenation/dehydrogenation component and a non-acidic form of zeolite beta.

FEEDSTOCKS

The feedstock charge can be at least one $C_2$–$C_5$ paraffin or a $C_6$–$C_{12}$ paraffin; or it can be straight run, thermal or hydrocracker naphthas or any other naphtha. Preferably the naphtha is a paraffin rich naphtha, particularly rich in $C_6$ to C12 paraffins. The $C_6$ and $C_7$ paraffins are generally difficult to reform selectively using conventional catalysts (such as chlorided Pt-alumina).

Naphthas exhibit boiling point temperature ranges of up to about 400° F. The light naphtha fraction thereof will exhibit a boiling point temperature range of from about 80° to about 250° F.

Initial hydrotreating of a hydrocarbon feed serves to convert sulfur, nitrogen and oxygen derivatives of hydrocarbon to hydrogen sulfide, ammonia, and water while depositing metal contaminant from hydrodecomposition of any organo-metal compounds. Where desired, interstage processing of the effluent from the hydrotreating zone may be effected. Such interstage processing may be undertaken, for example, to provide additional hydrogen, to add or remove heat or to withdraw a portion of the hydrotreated stream for treatment which need not be reformed. Hydrotreating of the heavy naphtha fraction may be essential, prior to reforming in a conventional reforming process. Suitably, the temperature in the hydrotreating catalyst bed will be within the approximate range of 550° F. to 850° F. The feed is conducted through the bed at an overall space velocity between about 0.1 and about 10 and preferably between about 0.2 and about 2, with hydrogen initially present in the hydrotreating zone in an amount between about 1000 and 10,000 standard cubic feet per barrel of feed, corresponding to a ratio of between about 2.4 and about 24 moles of hydrogen per mole of hydrocarbon.

The hydrotreating catalyst may be any of the known hydrotreating catalysts, many of which are available as staple articles of commerce. These hydrotreating catalysts are generally metals or metal oxides of Group VIA and/or Group VIII deposited on a solid porous support, such as silica and/or metal oxides such as alumina, titania, zirconia or mixtures thereof. Representative Group VIA metals include molybdenum, chromium and tungsten and Group VIII metals include nickel, cobalt, palladium and platinum. These metal components are deposited in the form of metals or metal oxides, on the indicated supports in amounts generally between about 0.1 and about 20 weight percent. After hydrotreating the sulfur content can be reduced so that the feed contains 1 to 50 ppm sulfur.

DEHYDROGENATION-DEHYDROCYCLIZATION-REFORMING CONDITIONS

The temperature at which the $C_6$–$C_{12}$ paraffin feed (or $C_6$–$C_{12}$ paraffin containing naphtha feed) is converted in accordance with the invention can range from 750° F. (400° C.) to 1100° F. and 1200° F., generally being greater than about 900° F. Preferably, the temperature of the process ranges from about 900° F. (482° C.) to about 1050° F. The pressure can be subatmospheric, atmospheric to greater than atmospheric and practically will be up to 500 psig; and it is noted that the non-acidic catalyst used in accordance with the invention can operate effectively even at low total pressures of 0 to 100 psig.

In addition, hydrogen must be purposefully added during the dehydrocyclization of the invention. The partial pressure of hydrogen created by hydrogen production during the dehydrocyclization will not allow the process of the invention to sustain long periods of time. Hydrogen addition is undertaken so that the $H_2$/hydrocarbon feed mole ratio ranges from 1 to 20. The liquid hourly space velocity [LHSV] can range from 0.1 to 20.

In accordance with the invention, catalytic dehydrogenation of $C_2$–$C_5$ paraffins includes pressures varying from subatmospheric, to atmospheric to greater than atmospheric. Preferred pressures range from 0.1 atmospheres to 30 psig. However pressures up to 500 psig can be employed. The dehydrogenation is conducted at elevated temperatures ranging from 300° C. to 700° C.; preferably, the temperatures range from 300° C. (572° F.) to 600° C. and most preferably from 400° C. to 600° C. Reactor inlet $H_2$/feed ratios are 5 or less; even at reactor inlet ratios of zero (0), there will be a hydrogen partial pressure in the reactor because hydrogen is a bi-product of dehydrogenation. The liquid hourly space velocity is 0.1 to 50, preferably 0.5 to 10.

The catalyst of the invention is non-acidic and comprises a strong dehydrogenation/hydrogenation metal and zeolite beta in non-acidic form.

The catalyst comprises the hydrogenation metal in an amount ranging from 0.01 to 30 weight percent and preferably from 0.02 to 10 weight percent. This component can be a Group VIII metal; it can be those including platinum; platinum-rhenium; platinum with iridium; rhenium, rhodium or mixtures thereof; but preferably, it is platinum.

Generally, zeolites are used in acidic form, for example, by treating the as synthesized zeolite with a source of $NH_4$+ to exchange at aluminum sites and followed by calcining to evolve $NH_3$, thereby leaving a proton at the aluminum site. The term "acidic" as used herein refers to the catalytic effect of zeolites, to crack large molecules to lower molecular weight molecules.

In accordance with the invention the zeolite, zeolite beta, is rendered non-acidic by treatments reslting in removal of those protons at aluminum sites. Zeolite beta, its preparation and its X-ray diffraction pattern are described in U.S. Pat. No. 3,308,069 and RE 28,341, the entire contents of which are incorporated herein by reference. As employed herein the silica:alumina ratio of zeolite beta can range from 10 to greater than 200. The zeolite beta may be dealuminated as described in U.S. Pat. No. 4,419,220 which is incorporated herein by reference or by treatment with hexafluorosilicate. It may contain other framework elements such as boron, iron, gallium, and chromium.

In accordance with the invention, zeolite beta is in a form in which the framework aluminum sites contain, rather than protons which render the zeolite acidic, a cation selected from Group IA or Group IIA. The term "non-acidic" as used herein, to define the catalyst composition relates to reduction of the acid content of zeolite beta, by ion exchange with Group IA and/or IIA cations preferably subsequent to inclusion of the Group VIII metal and subsequent to thermal treatment of the Group VIII metal containing zeolite substrate. In some cases, such as in boron-containing zeolite beta, neutralization can be concurrent with platinum incorporation.

The non-acidic catalysts can contain Group IA and/or Group IIA cations in excess of the framework aluminum content of the zeolites. In a preferred embodiment, the cation is cesium.

In an embodiment of the invention the zeolite is titrated with the Group IA or IIA in ion-exchangeable form, until a pH of greater than 7 is achieved. Most preferably, the ion-exchangeable form of the Group IA or Group IIA cation exchanged zeolite renders water to have a pH greater than 7.

When cesium is the cation, its source is preferably CsOH.

If the catalytic composition contains a binder, which is in itself acidic, then the zeolite beta and the binder are rendered non-acidic simultaneously. In specific embodiments below the treatment to render them neutral is subsequent to the Group VIII metal incorporation.

The Group VIII metal is incorporated into the zeolite beta, after calcination of the zeolite, in the form of a aqueous solution. The aqueous solution contains at least one Group VIII metal salt to exchange or sorb ionic Group VIII metal into the zeolite. Illustrative of suitable platinum compounds are chloroplatinic acid, platinum chloride, platinum amine complexes, and the like.

After contact of a slurry of the zeolite with the aqueous solution of the Group VIII metal compounds, the zeolite material is washed and dried at a temperature of about 100° C.

Thereafter, the Group VIII metal-containing zeolite is subjected to a thermal treatment, by heating the zeolite substrate in contact with a reducing, oxidizing, or inert environment. The environment can be air, hydrogen, nitrogen, or the like. This thermal treatment is conducted at a temperature ranging between about 150° to 550° C., for a period of time sufficient to achieve the desired conversion state, contact time ranging from between about 0.2 to 10 hours.

The following examples serve to illustrate the invention, rather than to limit it.

EXAMPLES

Example 1

Two non-acidic platinum/zeolite beta catalysts were prepared by cesium hydroxide neutralization [to a pH of 9] of a binder-free (Catalyst A) and an aluminum-bound acidic platinum/zeolite beta catalyst (Catalyst B). The binder-free sample was analyzed to contain 1.2 percent platinum; 14% cesium and 1.6% aluminum. The other sample contained 35 percent $Al_2O_3$; 0.3 percent platinum and 6.4 percent cesium. 1, Hexane aromatization was conducted at 1000° F., atmospheric pressure at about 6:1 $H_2/C_6$ hydrocarbon feed mole ratio, in an automated unit. Selectivities to benzene, at approximately 50 percent conversion were about 50-60 percent, while $C_3$- selectivity was about 4 percent. See Table 1 below. Overall activities for hexane conversion were comparable to that obtained over monofunctional acidic catalysts having alpha activities in the 100–400 alpha range. Under similar reaction conditions, n-heptane yielded a mixture of benzene and toluene in a 50–70 percent total yield.

Example 2

Boron Containing Non-acidic Platinum Beta Zeolite 10 grams of an acidic boron containing beta (silica:alumina ratio—273) was slurried in 250 ml of 0.5M $NaHCO_3$ containing 200 mg $Pt(NH_3)_4Cl_2$at room temperature overnight. The filtered, washed, dried material was then calcined in oxygen to 350° C. at 0.5° C./minute. This catalyst (Catalyst C) contained 0.88 % Pt; 0.51 B; 1.5% Na; 0.26% Aluminum.

EXAMPLE 3

Comparison: Cesium-Platinum-Potassium Containing Zeolite L

A non-acidic platinum on potassium-zeolite L was prepared for comparison purposes.

10.0 grams of K-zeolite L (Linde SK-45) was ion exchanged with 300 mg of $Pt(NH_3)_4Cl_2$ in 250 ml water at a pH of 9.5. The washed and dried catalyst was calcined in oxygen to 350° C. at 0.5° C./min. and then treated with dilute CsOH to a pH of 9.0. The final catalyst (Catalyst L) contained 1.5% Pt; 1.9% Cs.

The results of aromatization of n-hexane in the presence of the foregoing catalysts is tabulated in TABLE 1:

TABLE 1

| | Aromatization of n-Hexane@ | | |
|---|---|---|---|
| Catalyst | Conversion | Benzene Selectivity | $C_3$-Selectivity |
| A | 43.5% | 49.3% | 4.0% |
| A | 26.8% | 43.5% | 2.2% |
| B | 51.1% | 62.4% | 4.4% |
| B | 26.9% | 53.1% | 2.5% |
| C | 48.0% | 55.4% | 3.5% |
| L | 55.8% | 56.3% | 25.1% |
| L | 27.1% | 51.4% | 17.3% |

@Aromatization was undertaken at 1000° F.; atmospheric pressure; 6:1 $H_2$/Hexane feed; data taken after 3 hours on stream.

While the benzene selectivity is comparable between catalysts A, B, C and L, Catalyst L produced much more light gases at comparable converison levels, than did the other catalysts.

What is claimed is:

1. A process for producing aromatic compounds and for reducing the $C_6$–$C_{12}$ paraffin content of a $C_6$–$C_{12}$ paraffin containing feed comprising contacting a $C_6$–$C_{12}$ paraffin containing feedstock, under reforming conditions, in the presence of hydrogen, with a non-acidic catalyst composition comprising 0.01 to 30 weight percent of a reforming dehydrogenation/hydrogenation metal and zeolite beta in a non-acidic form; and recovering aromatic products.

2. The process of claim 1, wherein said metal is a Group VIII metal.

3. The process of claim 1, wherein said metal is platinum.

4. The process of claim 1, wherein platinum is incorporated with the zeolite by ion exchange, impregnation, or admixture.

5. The process of claim 4, wherein platinum incorporation into zeolite beta precedes the conversion of zeolite beta from its acid form to its non-acidic form.

6. The process of claim 1, wherein the reforming temperature ranges from 750° to 1200° F.

7. The process of claim 1, wherein the hydrogen:hydrocarbon feed mole ratio ranges from 1 to 20.

8. The process of claim 1, wherein the reforming conditions include a liquid hourly space velocity of 0.1 to 20.

9. The process of claim 6, wherein said hydrogen is present in an amount expressed as $H_2$/feed mole ratio ranging from 1 to 20.

10. The process of claim 1, wherein the reforming conditions include a pressure of 0 to 100 psig.

11. The process of claim 9, wherein the reforming conditions include a pressure of about 0 to 100 psig.

12. The process of claim 5, wherein conversion of zeolite beta from its acid form to its non-acidic form comprises treating zeolite beta in its acid form with an aqueous solution of a water soluble source of a metal selected from the group consisting of Group IA and Group IIA of the Periodic Table of Elements until the pH of the mixture resulting from said treatment is at least about 8.

13. The process of claim 12, wherein the reforming conditions include a pressure of about 0 to 100 psig.

14. The process of claim 13, wherein said hydrogen is present in amount expressed as $H_2$/feed mole ratio ranging from 1 to 20.

15. The process of claim 12 wherein said metal is cesium.

16. The process of claim 1, wherein the reforming dehydrogenation/hydrogenation metal is incorporated into zeolite beta, followed by calcination, and then the calcined zeolite beta containing said reforming dehydrogen/hydrogenation metal is treated with a water soluble source of a metal selected from the group consisting of Group IA and Group IIA of the Periodic Table of Elements.

17. The process of claim 16, wherein said Group IA metal is cesium.

18. The process of claim 1, wherein said xeolite beta is characterized by a silica:alumina ratio of 10 to 200.

19. The process of claim 1, wherein said zeolite beta is characterized by a silica:alumina ratio greater than 200.

20. The process of claim 1, wherein said zeolite beta is dealuminized zeolite beta.

21. The process of claim 1, wherein said zeolite beta contains boron and wherein said boron ranges from 0.1 to 5%.

22. The process of claim 1 wherein said feed contains sulfur in an amount ranging from 1 to 50 ppm.

23. The process of claim 1, wherein said non-acidic catalyst composition is base exchanged.

24. A process for reforming a paraffin rich naphtha feed, comprising contacting said feed, under reforming conditions, in the presence of hydrogen, with a base exchanged catalyst composition comprising 0.1 to 30 weight percent of a reforming hydrogenation/dehydrogenation metal and zeolite beta in a non-acidic form; and recovering an effluent of aromatic content greater than that of the feed.

25. The process of claim 24, wherein said metal is a Group VIII metal.

26. The process of claim 24, wherein said metal is platinum.

27. The process of claim 24, wherein platinum is incorporated with the zeolite by ion exchange, impregnation, or admixture.

28. The process of claim 24, wherein platinum incorporation into zeolite beta precedes the conversion of zeolite beta from its acid form to its non-acidic form.

29. The process of claim 4, which further includes the step of calcination after said incorporation and prior to said conversion.

30. The process of claim 24, wherein the reforming temperature ranges from 750° to 1200° F.

31. The process of claim 24, wherein the hydrogen:-hydrocarbon feed mole ratio ranges from 1 to 20.

32. The process of claim 24, wherein the reforming conditions include a liquid hourly space velocity of 0.1 to 20.

33. The process of claim 24, wherein said hydrogen is present in an amount expressed as $H_2$/feed mole ratio ranging from 1 to 20.

34. The process of claim 24, wherein the reforming conditions include a pressure of 0 to 100 psig.

35. The process of claim 24, wherein conversion of zeolite beta from its acid form to its non-acidic form comprises treating zeolite beta in its acid form with an aqueous solution of a water soluble source of a metal selected from the group consisting of Group IA and Group IIA of the Periodic Table of Elements until the pH of the mixture resulting from said treatment is at least about 8.

36. The process of claim 35, wherein said Group IA element is cesium.

37. The process of claim 34, wherein said hydrogen is present in amount expressed as $H_2$/feed mole ratio ranging from 1 to 20.

38. The process of claim 24, wherein the hydrocarbon feed is hydrotreated, prior to said contacting under reforming conditions, by subjecting the naphtha to a hydrotreating catalyst bed at a temperature of 550° F. to 850° F. at a overall space velocity of between 0.1 and about 10, in the presence of hydrogen in the hydrotreating zone, wherein the hydrogen/feed mole ratio is between 2.4 and about 24 moles.

* * * * *